US008517329B2

(12) United States Patent
Nash et al.

(10) Patent No.: US 8,517,329 B2
(45) Date of Patent: Aug. 27, 2013

(54) EASEL STAND MOUNTABLE DISPLAY BOARD

(75) Inventors: James E. Nash, Bloomington, MN (US); Craig Thompson, Inver Grove Heights, MN (US); Daniel A. Japuntich, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 895 days.

(21) Appl. No.: 11/132,536

(22) Filed: May 19, 2005

(65) Prior Publication Data

US 2006/0016951 A1 Jan. 26, 2006

Related U.S. Application Data

(63) Continuation-in-part of application No. 29/210,038, filed on Jul. 26, 2004, now Pat. No. Des. 509,247.

(51) Int. Cl.

| | |
|---|---|
| ***A47B 97/04*** | (2006.01) |
| ***A47B 19/00*** | (2006.01) |
| ***B43L 1/00*** | (2006.01) |

(52) U.S. Cl.

USPC ..... 248/441.1; 248/460; 434/408; D19/52

(58) Field of Classification Search

USPC ..... 248/441.1, 442.2, 447, 447.1, 447.2, 248/451, 456, 459, 460, 450, 465; 40/748; 434/408, 409, 416, 417, 365; 108/25, 26; D14/341; D19/52

See application file for complete search history.

(56) References Cited

U.S. PATENT DOCUMENTS

| | | | | |
|---|---|---|---|---|
| 165,747 | A | 7/1875 | Meigs, Jr. | |
| 227,662 | A | 5/1880 | Thompson | |
| 3,011,988 | A | 12/1961 | Luedke | |
| 3,691,140 | A | 9/1972 | Silver | |
| D232,231 | S | 7/1974 | Langieri | |
| D246,180 | S | 10/1977 | Yamachi | |
| 4,584,356 | A | 4/1986 | Crivello | |
| 4,728,571 | A | 3/1988 | Clemens | |
| 4,773,786 | A | 9/1988 | Pozzobon | |
| 4,828,502 | A * | 5/1989 | Leahy | 434/416 |
| 4,885,332 | A | 12/1989 | Bilkadi | |
| 5,028,075 | A | 7/1991 | Donnelly | |
| 5,045,569 | A | 9/1991 | Delgado | |
| 5,104,085 | A * | 4/1992 | Brice | 248/441.1 |
| 5,104,929 | A | 4/1992 | Bilkadi | |
| 5,153,041 | A | 10/1992 | Clements et al. | |
| 5,163,845 | A | 11/1992 | Blassingame | |
| D332,466 | S | 1/1993 | Logan | |
| 5,292,099 | A * | 3/1994 | Isham et al. | 248/442.2 |
| D346,067 | S | 4/1994 | Bell et al. | |
| 5,351,928 | A | 10/1994 | Cooper et al. | |
| 5,397,091 | A | 3/1995 | Tsuar | |
| D362,662 | S * | 9/1995 | Baudot | D14/389 |

(Continued)

FOREIGN PATENT DOCUMENTS

| | | |
|---|---|---|
| WO | WO 94/19420 | 9/1994 |

*Primary Examiner* — Tan Le
(74) *Attorney, Agent, or Firm* — Yen Tong Florczak; Robert H. Jordan

(57) ABSTRACT

A display board that may be supported on an easel stand includes a panel having a display surface on a front side thereof. A mounting interface is positioned adjacent a top edge of the panel and is configured for engagement with any one of a plurality of unique easel stand securing means.

15 Claims, 5 Drawing Sheets

(56) References Cited

U.S. PATENT DOCUMENTS

| | | | | |
|---|---|---|---|---|
| D366,280 | S | 1/1996 | Henderson | |
| 5,501,603 | A | 3/1996 | Mueller et al. | |
| 5,518,217 | A | 5/1996 | Deutsch et al. | |
| 5,565,253 | A | 10/1996 | Crawford et al. | |
| 5,571,617 | A | 11/1996 | Cooprider et al. | |
| 5,626,478 | A | 5/1997 | Gatlin | |
| 5,720,464 | A | 2/1998 | Meinscher et al. | |
| D391,987 | S | 3/1998 | Jambhekar et al. | |
| 5,743,414 | A | 4/1998 | Baudino | |
| D395,639 | S * | 6/1998 | Ham et al. | D14/389 |
| D399,526 | S | 10/1998 | Brady | |
| 5,824,748 | A | 10/1998 | Kesti et al. | |
| D400,578 | S | 11/1998 | Takemura | |
| 5,941,713 | A | 8/1999 | Wayner et al. | |
| 5,947,437 | A | 9/1999 | Tate et al. | |
| 5,987,825 | A | 11/1999 | Rosen | |
| 5,989,676 | A | 11/1999 | Davis et al. | |
| 6,164,976 | A | 12/2000 | Wilson | |
| 6,170,792 | B1 * | 1/2001 | Miceli et al. | 248/441.1 |
| 6,189,594 | B1 * | 2/2001 | Carter | 160/135 |
| 6,241,528 | B1 * | 6/2001 | Myers | 434/408 |
| 6,263,602 | B1 | 7/2001 | Seiber et al. | |
| 6,265,061 | B1 | 7/2001 | Kang et al. | |
| 6,458,462 | B1 | 10/2002 | Kang et al. | |
| 6,527,243 | B1 | 3/2003 | Kume, Jr. | |
| 6,595,143 | B2 * | 7/2003 | London | 108/25 |
| 6,666,424 | B2 * | 12/2003 | Richardson | 248/460 |
| D509,247 | S * | 9/2005 | Nash | D19/52 |
| D520,562 | S * | 5/2006 | Nash | D19/52 |
| D521,068 | S * | 5/2006 | Newbould | D19/52 |
| D534,215 | S * | 12/2006 | Nakata | D19/52 |
| 2001/0040207 | A1 * | 11/2001 | Richardson | 248/460 |
| 2006/0016951 | A1 * | 1/2006 | Nash et al. | 248/441.1 |

* cited by examiner

EASEL STAND MOUNTABLE DISPLAY BOARD

CROSS REFERENCE TO RELATED APPLICATIONS

This application is a continuation-in-part of U.S. Design application No. 29/210,038, filed Jul. 26, 2004, issued as D509,247, the disclosure of which is incorporated by reference in its entirety herein.

BACKGROUND

Display boards such as dry-erase boards or "whiteboards" are commonly used for the presentation of graphics and written material during presentations. The majority of dry-erase boards consist of a writing surface and a surrounding frame, and are designed to be permanently hung or mounted to a wall. Permanently mounted boards are satisfactory for use in rooms where a constant need exists for the board, such as in classrooms. However, many presentations take place where a permanently installed board may not be available or desired (such as for aesthetic considerations). In such situations, at least the temporary availability of a board is desired.

There are examples of dry-erase boards that are portable. The portable dry-erase boards have easel stand-like legs incorporated into their design. Unfortunately, the portable boards tend to be bulky, complicated to set up, relatively unsteady during use, and provide limited display or writing space. Further, the portable boards are not very versatile, in that they can only be easily used with the incorporated legs and are therefore not readily adaptable to use with different support structures that may be available, such as easel stands (that may be sturdier than the incorporated legs), tabletops (that may be more appropriate in some applications), or available wall mounts. For example, many rooms that are used periodically for presentations or meetings, although not having permanently mounted boards, do have easel stands readily available. Commonly available are easel stands of the type designed to hold large pads of paper ("easel pads"), where individual sheets may be torn off to reveal a new sheet, or alternately flipped over the top of the pad as a "flip chart."

Easel stands maintain the easel pads on the easel stand in a variety of manners. For example, a tray may protrude from the easel stand to support the easel pad from the bottom, such that the top of the pad simply reclines against the easel stand. Some easel stands have posts extending from an upper portion of the easel stand that are designed to engage prepunched holes in a top portion of the easel pad. After the pad is positioned on the posts, a retaining member typically engages the ends of the posts to secure the pad. Other easel stands have a clamping member for accepting the top edge of an easel pad. The clamping members include spring-type clamps, manual clamps, and gravity-aided cam mechanisms, for example. Usually, clamping members have a capacity limited to dimensions of a typical easel pad thickness (e.g., approximately ¼ to ⅜ inch thick).

Given the above, a display board having improved performance and versatility would be desirable. In particular, a display board that is easily mounted to a variety of easel stands or other support structures is desirable.

SUMMARY

One aspect of the invention described herein provides a display board that may be supported on an easel stand. In one embodiment according to the invention, the display board comprises a panel having a display surface on a front side thereof. A mounting interface is positioned adjacent a top edge of the panel. The mounting interface is configured for releasable engagement with any one of a plurality of unique easel stand securing means, wherein the mounting interface has a thickness less than a thickness of the panel.

In another embodiment according to the invention, the board comprises a panel having a writing surface on a front side thereof, wherein the panel has a thickness greater than a capacity of an easel stand securing means. A mounting interface is positioned adjacent a top edge of the panel. The mounting interface has a thickness less than the thickness of the panel, and is configured for engagement with a clamp member of an easel stand and a support post member of an easel stand.

Another aspect of the invention described herein provides a portable display board. In one embodiment according to the invention, the display board comprises a hinged panel having a first thickness. The panel is selectively positionable in an open position and a closed position, wherein when the panel is in the open position a substantially continuous display surface is formed. A mounting interface is positioned adjacent the top edge of the panel. The mounting interface has a second thickness, wherein the second thickness is less than the first thickness. The mounting interface is configured for engagement with a clamp member of an easel stand and a support post member of an easel stand. A handle is positioned adjacent a lateral edge of the panel for transporting the display board when the panel is in the closed position.

DETAILED DESCRIPTION

Figure 1:
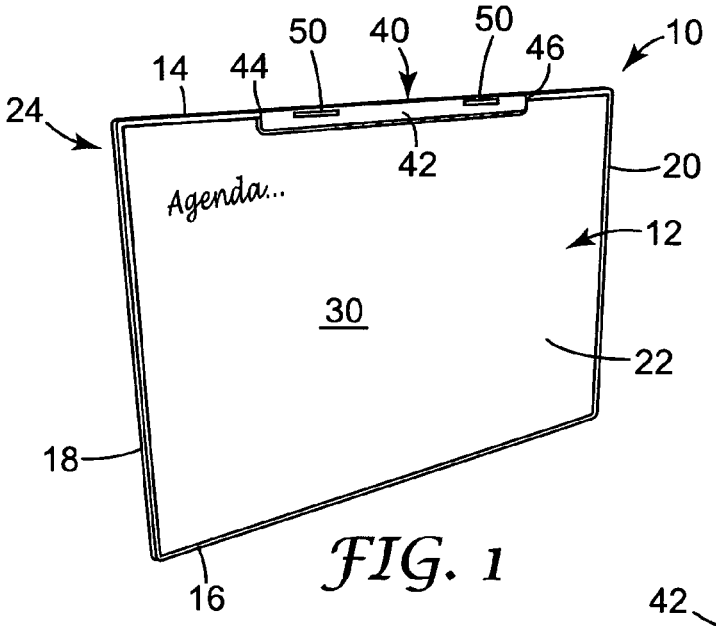
FIG. 1 is a perspective view of one embodiment of a display board according to the invention.

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the present invention is defined by the appended claims.

FIGS. 1-4 illustrate one embodiment of a display board 10 in accordance with the present invention. The display board 10 has the rigidity and appearance of a conventional wall mounted board. The display board 10 includes a generally planar panel 12 having a top edge 14, a bottom edge 16, two lateral or side edges 18, 20, a front side 22 and a back side 24. A display surface 30 is on the front side 22 of the panel 12.

Figure 4:
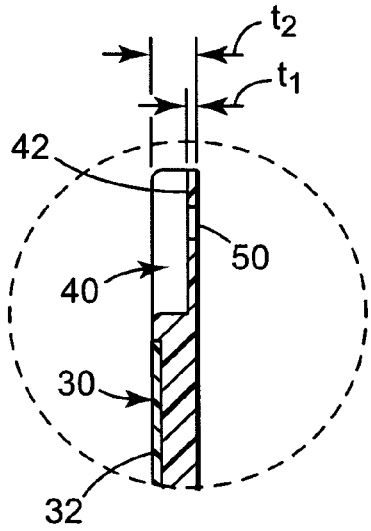
FIG. 4 is an enlarged cross-sectional view of circled portion 4 of FIG. 3.
Figure 5:
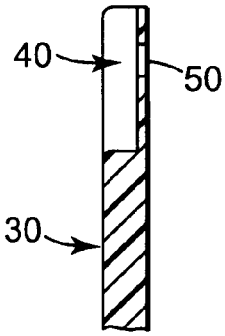
FIG. 5 is a cross-sectional view of another embodiment of a display board according to the invention.
Figure 6:
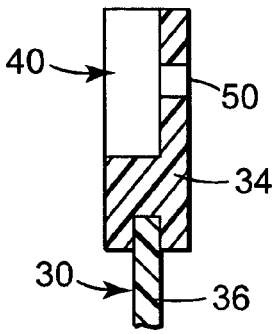
FIG. 6 is a cross-sectional view of yet another embodiment of a display board according to the invention.

In the illustrated embodiment, and referring specifically to the enlarged cross-section of FIG. 4, it can be seen that the display surface 30 is a material layer 32 attached to the front side of the panel 12. In another embodiment, the display surface 30 is integral with the panel 12 (e.g., the display surface 30 is not a separate and distinct material layer) (FIG. 5). In yet another embodiment, the top edge 14, bottom edge 16, and side edges 18, 20 of the panel 12 comprise a frame 34 surrounding and supporting a board member 36 having the display surface 30 thereon (FIG. 6).

The panel 12 may have any suitable size and aspect ratio (height to width), as is appropriate for its intended use. In one embodiment the panel 12 has a width (from side to side) of approximately 36 inches or greater, and preferably approximately 48 inches or greater. In one embodiment, the panel 12 is approximately 48 inches wide and 36 inches high (from top edge 14 to bottom edge 16). In the illustrated embodiments, the panel has a "landscape" orientation, wherein the width of the panel is greater than the height of the panel. In other embodiments, the panel 12 may have a "portrait" orientations, wherein the height of the panel is greater than the width of the panel.

The display surface 30 may be provided with any of a variety of functional attributes. Exemplary functional attributes of the display surface 30 include, but are not limited to, a writable surface such as a dry-erase board or a chalk board, a tackified adhesive surface, a magnetic surface, or a cork board. The display surface 30 may have more than one functional attribute. In one embodiment, different functional attributes are associated with different portions of the display surface 30. For example, a first portion of the display surface 30 may be a writable surface, while a second portion of the display surface 30 is a tackified adhesive surface. In another embodiment, different functional attributes are associated with the same portion of the display surface 30. For example, a writable surface may also be a magnetic surface.

The panel 12 includes a mounting interface 40 adjacent the top edge of the panel 12. The mounting interface 40 is configured for use with any of a plurality of unique securing or mounting means, such that the versatility of the display board 10 is increased. In one embodiment, the mounting interface 40 includes features enabling the display board 10 to make use of the various clamps, support posts, and cam mechanisms most often found on easel stands that were originally designed for thinner easel pads. In one embodiment, the mounting interface 40 is configured to allow the display board 10 to be mounted on a wall as a conventional wall-mounted board, and then easily removed from the wall for use with any of a variety of easel stands.

Figure 7:
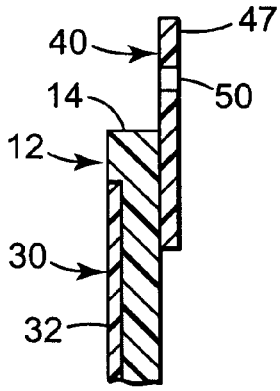
FIG. 7 is a cross-sectional view of yet another embodiment of a display board according to the invention.
Figure 3:
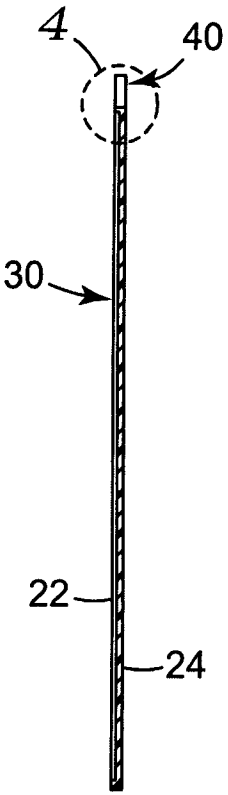
FIG. 3 is a cross-sectional view taken along line 3-3 of FIG. 2.
Figure 2:
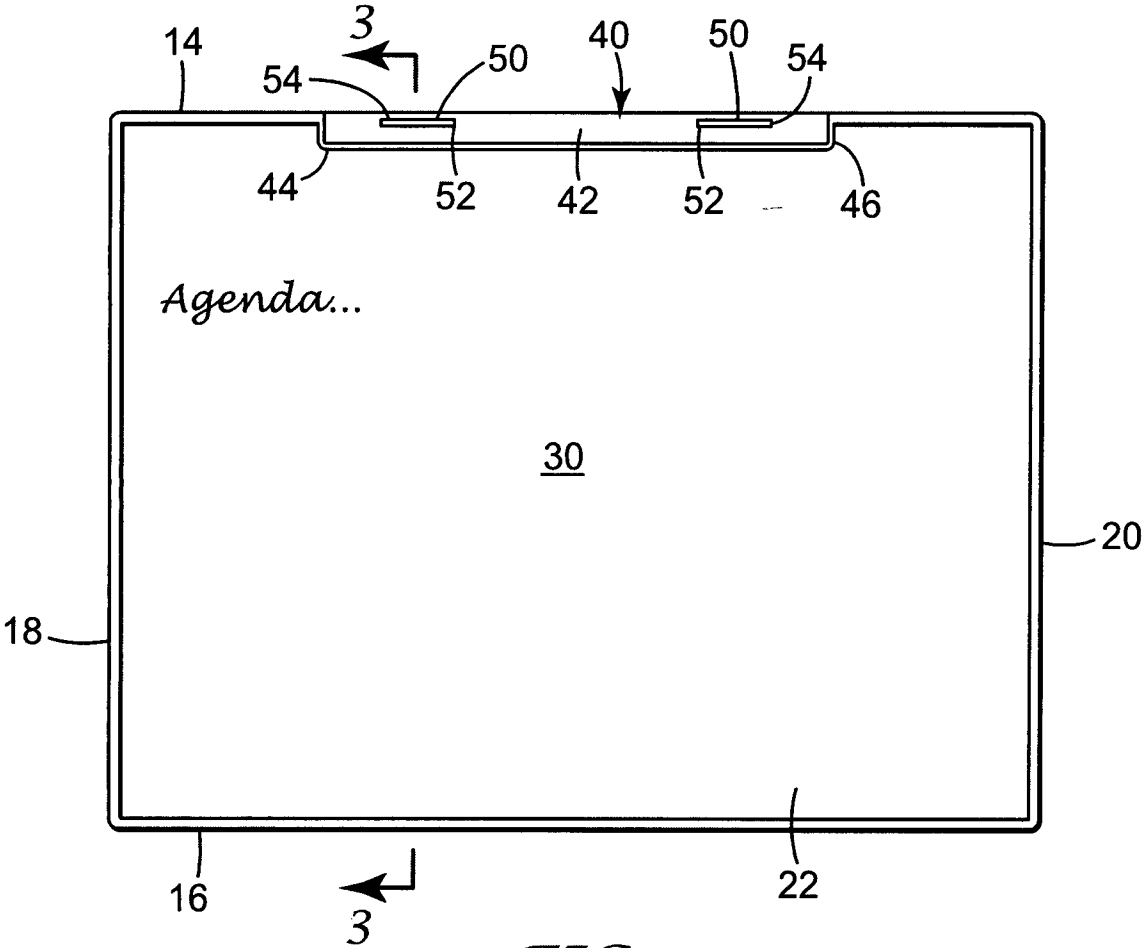
FIG. 2 is a front view of the display board of FIG. 1.

As can best be seen in FIGS. 3 and 4, the mounting interface 40 comprises a recessed portion 42 having a reduced thickness extending along the top edge 14 of the panel 12. In one embodiment, the mounting interface 40 is generally centered along the top edge of the panel 12, and the reduced thickness of the mounting interface 40 extends from a first lateral end 44 to a second lateral end 46. The mounting interface 40 has a thickness $t_1$ that is less than a maximum thickness $t_2$ of the panel 12. The thickness $t_1$ is approximately equal to the thickness of commonly available easel pads, and is selected such that reduced thickness of the mounting interface 40 can be received by clamping members of the type commonly found on easel stands. In one embodiment, the thickness $t_1$ is approximately ⅜ inch or less. In another embodiment, the thickness $t_1$ is approximately 0.2 inches. To accommodate commonly available easel stand sizes and configurations, and presuming the panel 12 is large enough, the mounting interface 30 extends along the top edge 14 of the panel 12 for a distance of at least approximately 24 inches, and extends from the top edge 14 toward the center of the panel 12 for a distance of approximately 1.5 inches. In another embodiment, mounting interface 40 having reduced thickness extends across all or substantially all of the top edge 14 of the panel 12. In one embodiment, at least the lateral ends 44, 46 of the mounting interface 40 have a thickness greater than $t_1$ to provide additional rigidity and strength to the mounting interface 40. In an alternate embodiment, rather than being a recessed portion integrally formed in the panel 12, the mounting interface 40 is a separate flange element 47 attached to the panel 12 and extending above the top edge of the panel 12 (FIG. 7).

In one embodiment, the thickness $t_1$ of the mounting interface 40 is substantially constant from side to side and from top to bottom. In one embodiment, the thickness $t_1$ of the mounting interface 40 decreases from the top edge 14 toward the center of the panel 12. The constant thickness, or decreasing thickness from the top edge 14 toward the center of the panel 12 increases the ability of a clamping member to securely engage the mounting interface 40. In one embodiment, at least one of the front surface 22 and the back surface 24 of the mounting interface 40 is adapted to further aide engagement with a clamp member. In one embodiment, at least one of the front surface 22 and the back surface 24 of the mounting interface 40 includes a ribbed surface, a grooved surface, or other textured surface, such that the surface resists slipping when clamped. In another embodiment, at least one of the front surface 22 and the back surface 24 of the mounting interface 40 includes a non-skid material.

In one embodiment, the mounting interface 40 includes elongated through-slots 50 positioned adjacent opposite lateral ends 44, 46 of the mounting interface 40. The through-slots 50 are generally parallel to the top edge 14 of the panel 12, and adapted to receive support members, such as posts or pins, of an easel stand therein. The positions and dimensions of the slots 50 are selected to maximize the variety of easel stand support members that the slots 50 may receive. The through-slots 50 may also receive support posts extending from a wall, such that the display board 10 may be removably supported thereon. In one embodiment, the slots 50 are positioned approximately 0.5 inches or less from the top edge 14. In one embodiment, the inner ends 52 of the slots 50 are spaced at least approximately 12 inches apart. In one embodiment, the outer ends 54 of the slots 50 are spaced no more than approximately 22 inches apart. In one embodiment, the slots 50 are configured to receive a post or pin having a diameter of approximately ¼ to ⅜ inches.

Figure 8:
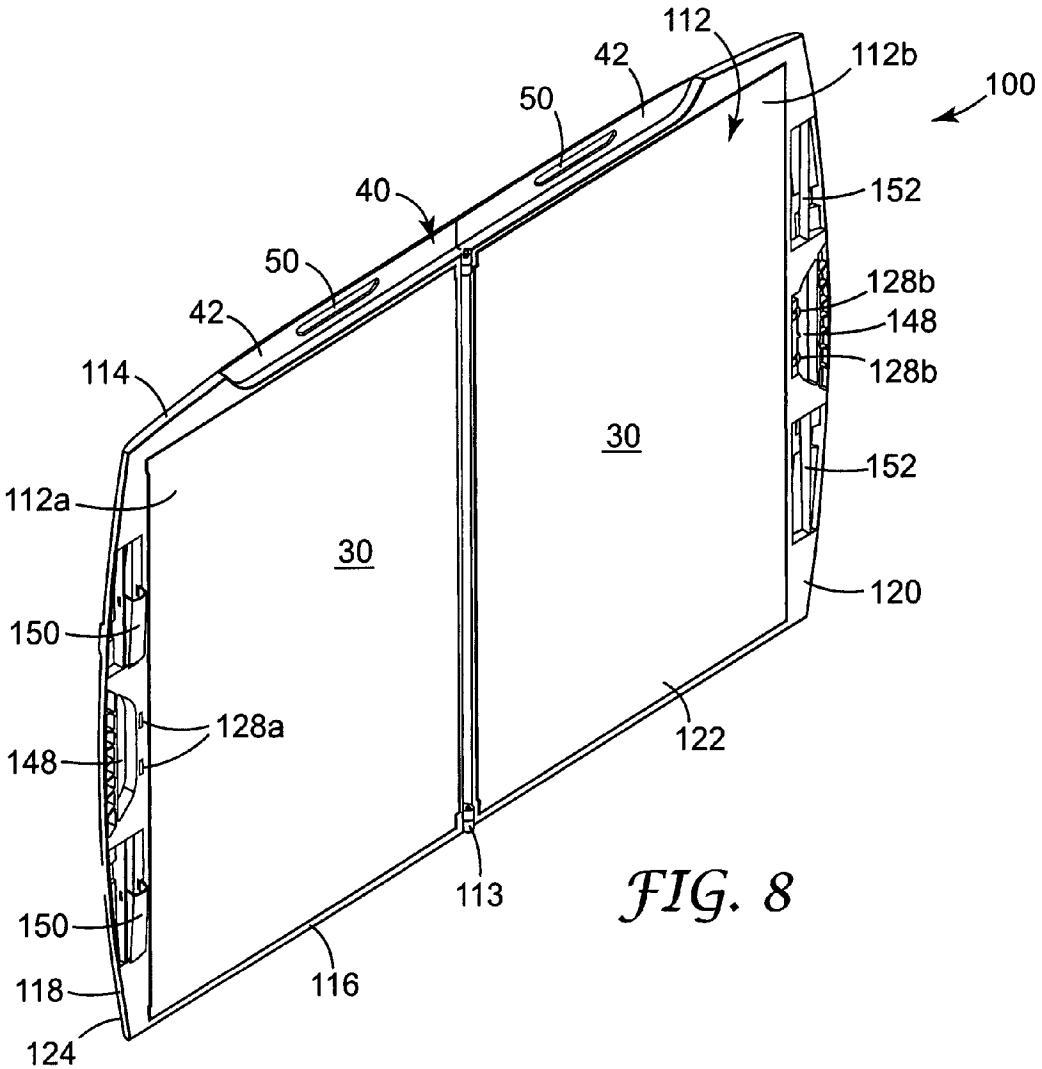
FIG. 8 is a perspective view of one embodiment of a foldable display board according to the invention.
Figure 9:
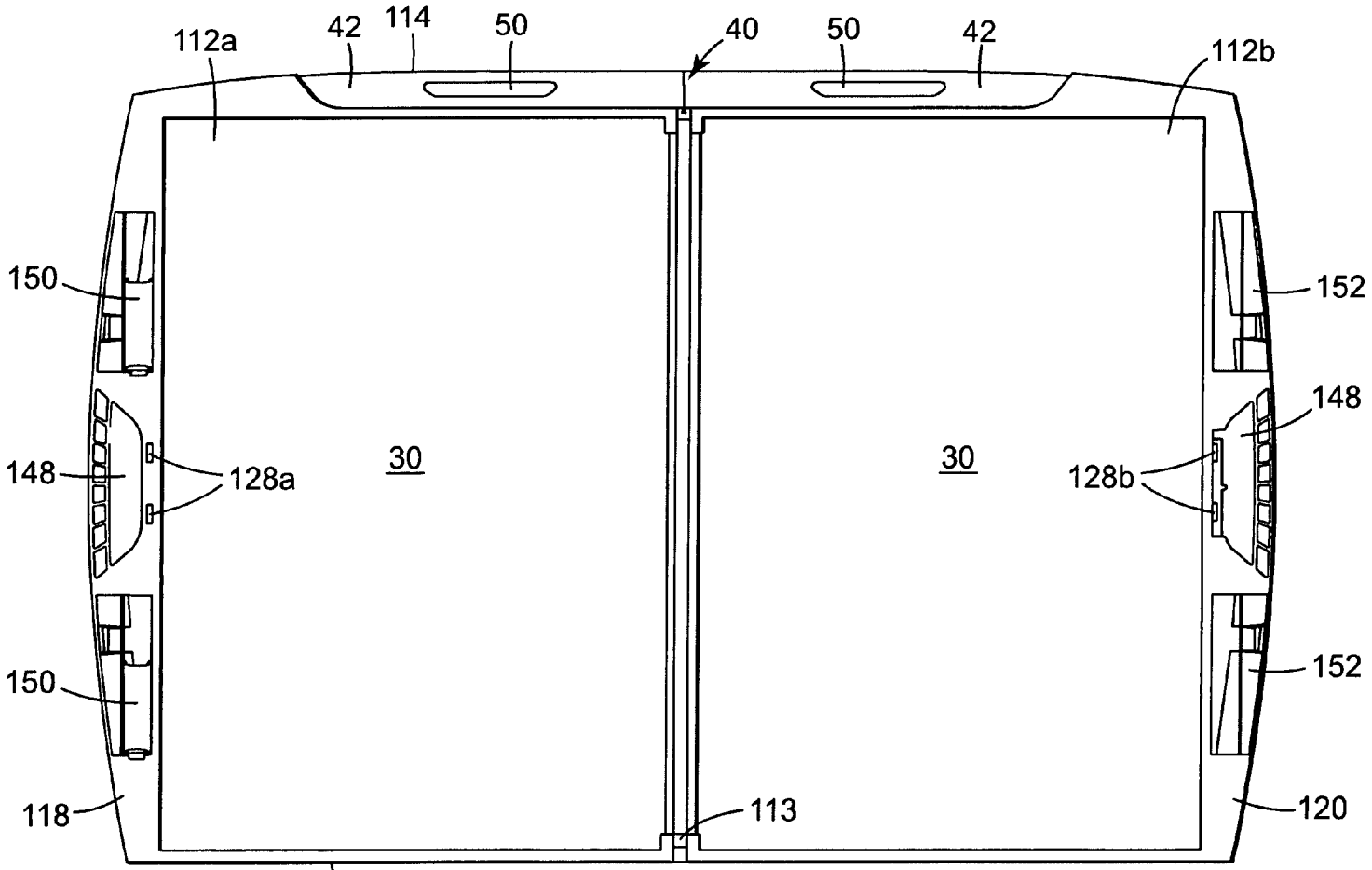
FIG. 9 is a front view of the foldable display board of FIG. 8 in an open position.
Figure 10:
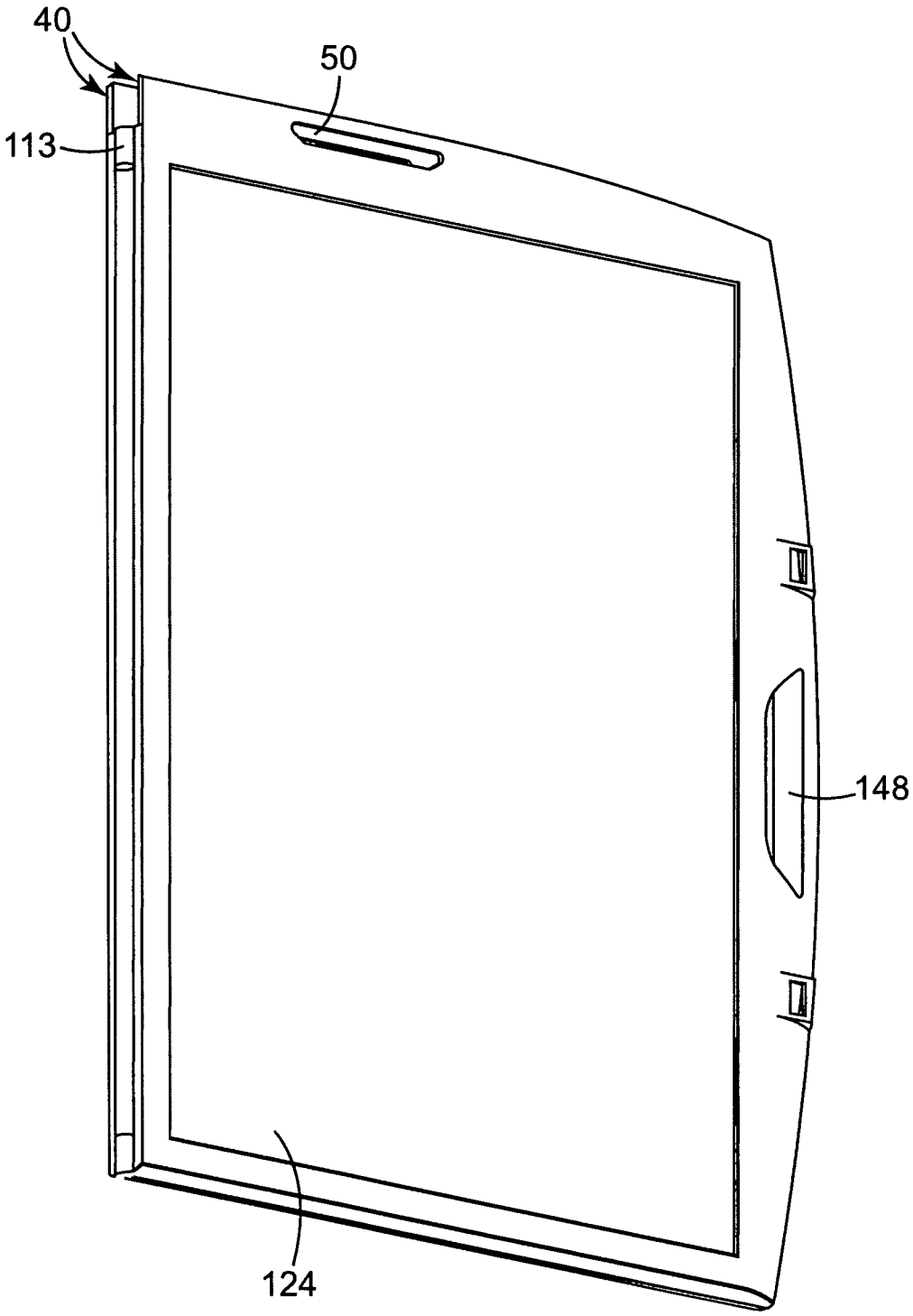
FIG. 10 is perspective view of the foldable display board of FIG. 8 in a closed position.

Another embodiment of a display board 100 according to the invention is illustrated in FIGS. 8-10. The display board 100 of FIGS. 8-10 includes panel 112 having top edge 114, bottom edge 116, lateral or side edges 118, 120, front surface 122, and back surface 124. Panel 112 is divided into a first panel section 112*a* and a second panel section 112*b*. The first and second panel sections 112*a*, 112*b* are pivotally attached to each other by a hinge 113. In one embodiment, the hinge 113 substantially bisects the top and bottom edges 114, 116 of the panel 112, although other positions and orientations of the hinge 113 are contemplated. For example, the hinge could be oriented so as to bisect the side edges 118, 120. The first and second sections 112*a*, 112*b* are selectively positionable in an open position (FIGS. 8 and 9) and a closed position (FIG. 10). In one embodiment, the display board 100 includes a latching mechanism 126 to maintain the first and second panel sections 112*a*, 112*b* in the closed position. In one embodiment, the first and second panel sections 112*a*, 112*b* of the display board 100 includes a latching mechanism 128*a*, 128*b*, respectively, to maintain the first and second panel sections 112*a*, 112*b* in the closed position. Optionally, a latching mechanism may be provided to maintain the display board 100 in the open position.

Each of the first and second panel sections 112*a*, 112*b* have a display surface 30 thereon. The display surfaces 30 of the first and panel sections 112*a*, 112*b* are like that described above with respect to FIGS. 1-7. In one embodiment, the display surfaces 30 of the first and second panel sections 112*a*, 112*b* are the same type of display surface (e.g., both dry-erase surfaces, both tackified adhesive surfaces, etc.). In one embodiment, the display surfaces 30 of the first and second panel sections 112*a*, 112*b* are different types of display surfaces (e.g., one dry-erase surface and one tackified adhesive surface, etc.). When the first and second panel sections 112*a*, 112*b* are in the open position, the display surfaces 30 of the first and second panel sections 112*a*, 112*b* are substantially contiguous and coplanar.

In one embodiment, each of the first and second panel sections 112*a*, 112*b* have a portion of a mounting interface 40 thereon. When the first and second panel sections 112*a*, 112*b* are in the open position, the portions of the mounting interface 40 of the first and second panel sections 112*a*, 112*b* form a complete mounting interface 40 substantially as described above with reference to FIGS. 1-7.

In one embodiment, at least one of the first and second panel sections 112*a*, 112*b* has a handle for transporting the display board 100. In one embodiment, at least one of the first and second panel sections 112*a*, 112*b* includes an elongated opening 148 extending substantially parallel to the side edges 118, 120 to form a handle for transporting the display board 100 when the first and second sections 112*a*, 112*b* are in the closed position. In one embodiment, both the first and second panel sections 112*a*, 112*b* include an elongated opening 148 extending substantially parallel to the side edges 118, 120, such that when the first and second sections 112*a*, 112*b* are in the closed position, the elongated openings 148 together form a handle for transporting the display board 100.

In one embodiment, the display boards 10, 100 are provided with one or more receptacles for holding items such as pens, markers, chalk, etc., that may be used with the display board. In FIGS. 8 and 9, receptacles 150 are provided on first panel section 112*a*, while cavities 152 are provided in second panel section 112*b* to receive receptacles 150 when the display board 100 is in a closed position.

Advantageously, the display boards 10, 100 of the present invention have the rigidity and appearance of a conventional wall mounted board, and can take advantage of existing easel stands brings to the boards a significant added utility. The display boards 10, 100 may be mounted on a wall, using hangers extending through the through slots 50 along the top edge of the board. The boards 10, 100 may then be easily removed from the wall, either for esthetic purposes or to transport the board to another location. The boards 10, 100 may further be supported on an easel stand having support pegs or posts extending therefrom, where the posts extend through the elongated through-slots 50. The boards 10, 100 may also be supported by a clamping member, such as a clamp on an easel stand, which engages the inner mounting interface 40. Being able to use an easel stand to position the display board for presentations or group communications (classes, brain storming, etc.) gives the display boards 10, 100 the increased versatility to be used in multiple locations without the steps associated with permanently hanging or mounting the boards to a wall.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the relevant arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A display board capable of being supported on an easel stand of the type having means for securing objects thereto, the board comprising:

a panel having a display surface on a front side thereof; and a mounting interface comprising a recessed area that is adjacent and extends along and from a top edge of the panel, the mounting interface configured for releasable engagement with any one of a plurality of unique easel stand securing means, wherein the mounting interface comprises (i) means for receiving support members of the easel stand, the means for receiving support members of the easel stand comprising two elongated through-slots positioned adjacent opposite ends of the mounting interface, the through-slots generally parallel to the top edge of the panel and adapted to receive support members of the easel stand, and (ii) means adapted to be clamped by a clamp member on the easel stand;

wherein the mounting interface has a thickness less than a thickness of the panel.

2. The display board of claim 1, wherein the means adapted to be clamped by a clamp member on the easel stand comprises a surface adapted to aid engagement with a clamp member.

3. The display board of claim 2, wherein the surface adapted to aid engagement with a clamp member comprises one of a ribbed surface and a grooved surface, the ribs and grooves extending generally parallel to the top edge of the panel.

4. The display board of claim 2, wherein the surface adapted to aid engagement by a clamp member comprises a non-skid surface.

5. The display board of claim 1, wherein the display surface is one of a writeable surface and a tackified adhesive surface.

6. A portable writing board capable of being supported on an easel stand of the type having means for securing objects thereto, the board comprising:

a panel having a writing surface on a front side thereof; and a mounting interface that is adjacent and extends along and from a top edge of the panel, the mounting interface having a thickness less the thickness of the panel, and configured for engagement with a clamp member of an easel stand and a support post member of an easel stand, wherein the mounting interface includes elongated through-slots for receiving support post members of an easel stand, and an engagement surface portion having clamping enhancement features for aiding engagement with a clamp member of an easel stand.

7. The portable writing board of claim 6, wherein at least the engagement surface portion of the mounting interface has a thickness less than a thickness of the panel.

8. The portable writing board of claim 6, wherein the writing surface comprises a dry-erase surface.

9. The portable writing board of claim 6, wherein the panel comprises a first section and a second section, each of the first and second sections having a portion of the writing surface, the first and second sections of the panel pivotally attached to each other and selectively positionable in an open position and a closed position, wherein when the first and second sections are in the open position, the display surface portions of the first and second sections are contiguous.

10. The portable writing board of claim 9, wherein each of the first and second sections have a portion of the mounting interface, and wherein when the first and second sections are in the open position, the mounting interface portions of the first and second sections are contiguous.

11. The portable writing board of claim 9, wherein at least one of the first and second sections have handle for transporting the display board.

12. The portable writing board of claim 6 wherein the mounting interface is generally centered along the top edge.

13. The portable writing board of claim 6 wherein the mounting interface extends across substantially all of the top edge.

14. The portable writing board of claim 6 wherein the recessed area extends from the top edge a distance of approximately 1.5 inches toward the center of the panel.

15. The portable writing board of claim 6 supported on an easel stand wherein the easel stand comprises means for securing objects selected from the group consisting of clamps, support posts, and cams wherein the means for securing object is engaged with the mounting interface and wherein the maximum thickness of the panel is thicker than the capacity of the means for securing objects.

* * * * *